US012584319B2

(12) United States Patent
Ayukawa et al.

(10) Patent No.: US 12,584,319 B2
(45) Date of Patent: Mar. 24, 2026

(54) SUPPORT MEMBER, SUPPORT STRUCTURE, AND OUTER WALL STRUCTURE

(71) Applicant: SEKISUI HOUSE, LTD., Osaka (JP)

(72) Inventors: Natsuki Ayukawa, Osaka (JP); Takashi Kimura, Osaka (JP); Toshiyuki Osada, Osaka (JP); Hiroki Yamaguchi, Osaka (JP); Tomoya Hatae, Osaka (JP)

(73) Assignee: SEKISUI HOUSE, LTD., Osaka (JP)

( * ) Notice: Subject to any disclaimer, the term of this patent is extended or adjusted under 35 U.S.C. 154(b) by 179 days.

(21) Appl. No.: 18/572,981

(22) PCT Filed: Jun. 30, 2021

(86) PCT No.: PCT/JP2021/024700
§ 371 (c)(1),
(2) Date: Dec. 21, 2023

(87) PCT Pub. No.: WO2023/276027
PCT Pub. Date: Jan. 5, 2023

(65) Prior Publication Data

US 2024/0287814 A1 Aug. 29, 2024

(51) Int. Cl.
*E04F 13/08* (2006.01)
*E04F 19/06* (2006.01)

(52) U.S. Cl.
CPC ..... *E04F 13/0833* (2013.01); *E04F 13/08* (2013.01); *E04F 13/0857* (2013.01); *E04F 19/061* (2013.01)

(58) Field of Classification Search
CPC . E04F 13/0833; E04F 19/061; E04F 13/0857; E04F 13/08
(Continued)

(56) References Cited

U.S. PATENT DOCUMENTS 2,191,660 A * 2/1940 Hirschey ..... E06B 1/62 49/404
2,561,142 A * 7/1951 Schiessl ..... E06B 3/9604 52/204.53
(Continued)

FOREIGN PATENT DOCUMENTS

JP 2013-72191 A 4/2013
JP 2016-37804 A 3/2016
(Continued)

OTHER PUBLICATIONS

International Search Report (PCT/ISA/210), issued in PCT/JP2021/024700, dated Sep. 14, 2021.

*Primary Examiner* — Brent W Herring
(74) *Attorney, Agent, or Firm* — Birch, Stewart, Kolasch & Birch, LLP

(57) ABSTRACT

A support member is a member for supporting a first outer wall surface material, and includes a support fixing part, a support extension, and an end surface support part. The support fixing part is fixed to a second surface of a wall base material provided in a manner of surrounding an opening, the second surface being located more to an outdoor side than a first surface adjacent to the opening. The support extension extends from the support fixing part to a region opposed to the first surface toward the opening side to support the first outer wall surface material from an indoor side. The end surface support part has an abutting surface that extends from the support extension to the outdoor side and abuts on one end surface of the first outer wall surface material on the opening side to support the one end surface.

14 Claims, 6 Drawing Sheets

(58) Field of Classification Search
USPC ..... 52/204.1, 211, 204.2, 213, 215
See application file for complete search history.

(56) References Cited

U.S. PATENT DOCUMENTS

| | | | | |
|---|---|---|---|---|
| 3,958,380 | A * | 5/1976 | Golten | E06B 1/003 49/504 |
| 6,161,344 | A * | 12/2000 | Blanchett | E06B 1/62 52/211 |
| 6,526,709 | B1 * | 3/2003 | Jacobsen | E06B 1/02 52/211 |
| 2016/0040419 | A1 | 2/2016 | Watanabe | |

FOREIGN PATENT DOCUMENTS

| | | | |
|---|---|---|---|
| JP | 2020-122350 | A | 8/2020 |
| JP | 2021-31998 | A | 3/2021 |

* cited by examiner

SUPPORT MEMBER, SUPPORT STRUCTURE, AND OUTER WALL STRUCTURE

TECHNICAL FIELD

The present invention relates to a support member, a support structure, and an outer wall structure.

BACKGROUND ART

As an outer wall structure of a building, there is a known structure in which a fitting such as a window sash provided in a manner of covering an opening communicating between the inside and the outside is disposed at a position back of an indoor side of an outer wall surface material. In such an outer wall structure, a thickness of the outer wall surface material can be emphasized by shadows cast around the fitting to make an appearance of the building substantial, thereby presenting luxurious feeling.

In this type of outer wall structure, a wall base material provided in a manner of surrounding an opening has a first surface adjacent to the opening and facing an outdoor side, and a second surface on a side of the first surface opposite to the opening and located more to the outdoor side than the first surface. Then, a fitting is attached to the first surface of the wall base material, and an outer wall surface material is supported along the second surface of the wall base material. An outer wall structure including a support member for supporting such an outer wall surface material is disclosed in, for example, Patent Literature 1.

In the outer wall structure disclosed in Patent Literature 1, an engagement member constituting a support member for supporting an outer wall surface material (outer wall material) is fixed to a water-stopping member attached to a second surface (surface on an outdoor side of a furring strip material) in order to restrict entry of water from an outdoor side to a first surface (surface on the outdoor side of a frame member). In this state, the engagement member supports the outer wall surface material such that a gap is formed between an end surface of the outer wall surface material on the opening side and a fitting (window sash). In the gap between the outer wall surface material and the fitting, a decorative member is disposed in a manner of protruding more to the outdoor side than the outer wall surface material.

When such a protruding object as a decorative member that protrudes more to the outdoor side than the outer wall surface material is present between the outer wall surface material and the fitting, the outer wall structure has deteriorated appearance.

CITATION LIST

Patent Literature

Patent Literature 1: JP 2016-37804 A

SUMMARY OF INVENTION

The present invention has been made in view of such circumstances, and an object of the present invention is to provide a support member and a support structure for supporting an outer wall surface material in a manner of covering a first surface of a wall base material without using a decorative member, and to provide an outer wall structure.

A support member according to one aspect of the present invention is a member for supporting an outer wall surface material in a manner of covering a to-be-attached part from an outdoor side with respect to an outer wall base including: a wall base material provided in a manner of surrounding an opening that communicates between indoor and outdoor sides and faces the side, and having a first surface adjacent to the opening and facing the outdoor side and a second surface provided on a side of the first surface opposite to the opening and positioned more to the outdoor side than the first surface; and a fitting attached to the wall base material in a manner of covering the opening, and having the to-be-attached part that is attached to the first surface in a state of being overlapped with the first surface from the outdoor side. The support member includes: a support fixing part fixed to the second surface; a support extension that extends from the support fixing part to a region opposed to the first surface toward the opening side to support the outer wall surface material from the indoor side; and an end surface support part that extends from the support extension to the outdoor side and has an abutting surface that abuts on one end surface of the outer wall surface material on the opening side to support the one end surface.

A support structure according to another aspect of the present invention includes: the above support member; and a restricting member attached to the fitting for restricting entry of water into the first surface from an outdoor side through between the restricting member and the outer wall surface material. Then, the restricting member has a contact surface extending from the fitting to the outdoor side and coming into contact with the end surface support part of the support member from the opening side.

An outer wall structure according to a further aspect of the present invention is an outer wall structure of a building. The outer wall structure includes: a wall base material provided in a manner of surrounding an opening that communicates between indoor and outdoor sides and faces the side, and having a first surface adjacent to the opening and facing the outdoor side and a second surface provided on a side of the first surface opposite to the opening and positioned more to the outdoor side than the first surface; a fitting attached to the wall base material in a manner of covering the opening, and having a to-be-attached part that is attached to the first surface in a state of being overlapped with the first surface from the outdoor side; an outer wall surface material provided for the wall base material and the fitting; and the support member for supporting the outer wall surface material in a manner of covering the to-be-attached part of the fitting from the outdoor side.

Objects, features, and advantages of the present invention will become more apparent from the following detailed description and the accompanying drawings.

DESCRIPTION OF EMBODIMENT

In the following, a support member and a support structure according to an embodiment of the present invention will be described with reference to the drawings. The support member and the support structure according to the present embodiment are applied to an outer wall structure of a building.

[Configuration of Outer Wall Structure]

Figure 1:
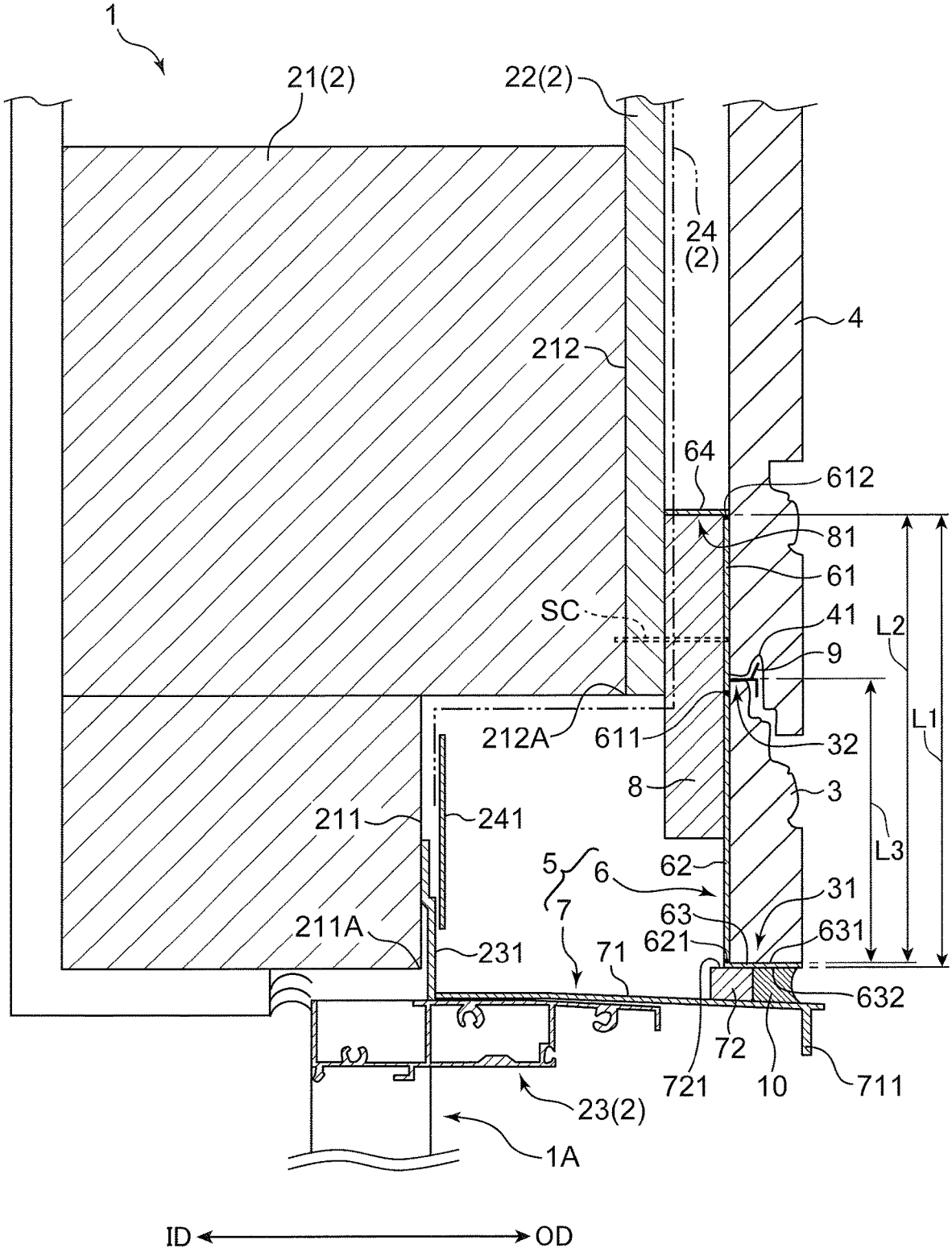
FIG. 1 is a side cross-sectional view illustrating an outer wall structure to which a support member and a support structure according to an embodiment of the present invention are applied.
Figure 2:
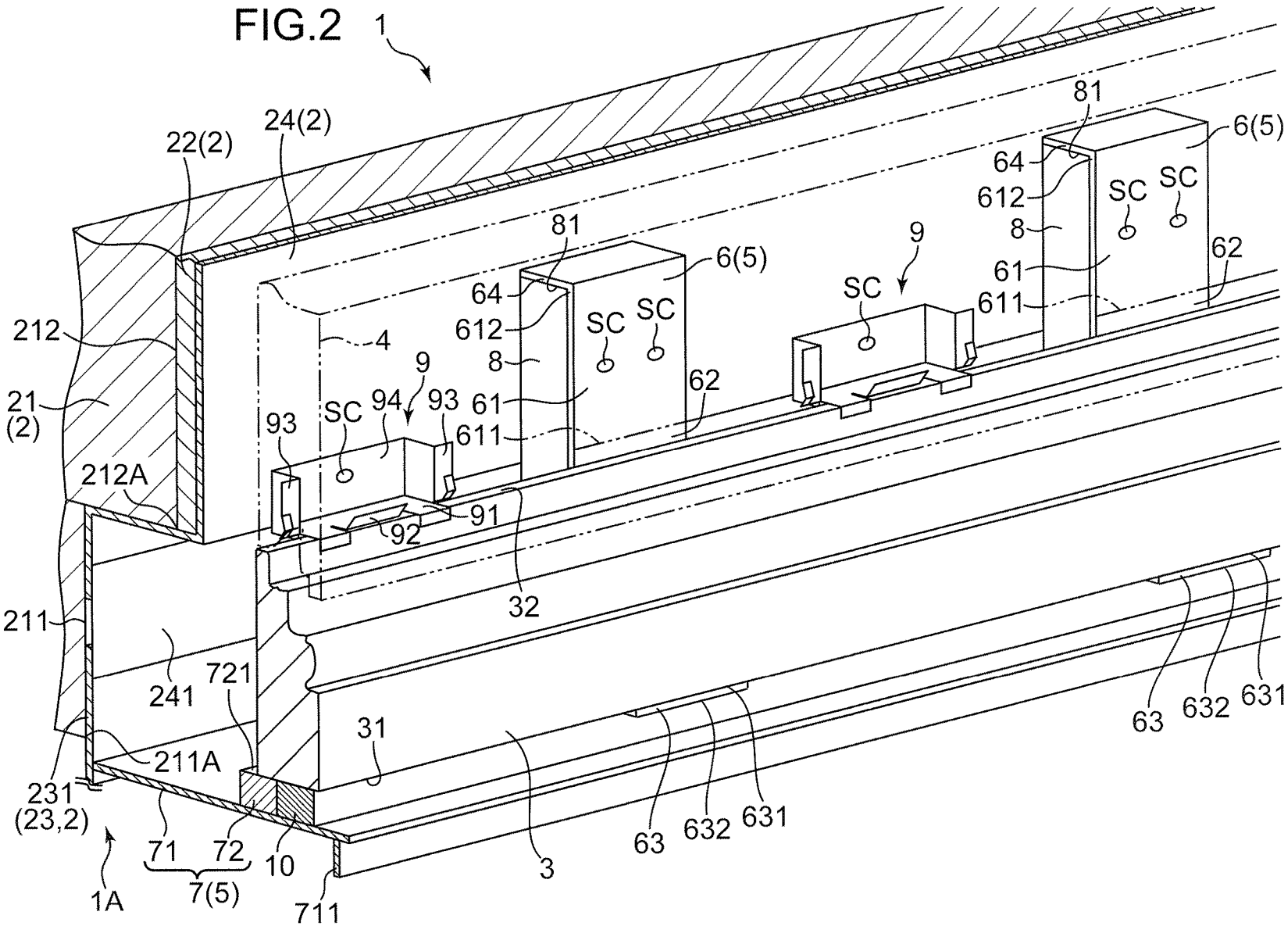
FIG. 2 is a perspective view of the outer wall structure.

As illustrated in FIGS. 1 and 2, an outer wall structure 1 includes an outer wall base 2, a first outer wall surface material 3 and a second outer wall surface material 4 provided at the outer wall base 2, and a support structure 5 for supporting the first outer wall surface material 3 and the second outer wall surface material 4.

The outer wall base 2 is a structure provided in a manner of surrounding an opening 1A that communicates between an indoor ID and an outdoor OD. The opening 1A has an opening edge formed in, for example, a rectangular shape. In the rectangular opening 1A, an opening upper edge and an opening lower edge extend in a horizontal direction orthogonal to a direction directed from the indoor ID to the outdoor OD, and an opening side edge extends in an up-down direction (vertical direction). In FIGS. 1 and 2, only the outer wall base 2 corresponding to the opening upper edge among the opening edges of the rectangular opening 1A is illustrated, and illustration of outer wall bases corresponding to the opening lower edge and the opening side edge is omitted. The outer wall base 2 includes a wall base material 21, a base plate 22, a fitting 23, and a waterproof sheet 24.

The wall base material 21 is a base material provided in a manner of surrounding the opening 1A. The wall base material 21 includes a first surface 211 that is adjacent to the opening 1A and faces the outdoor OD side, and a second surface 212 that is provided on a side of the first surface 211 opposite to the opening 1A and is located more to the outdoor OD side than the first surface 211. In the wall base material 21, the first surface 211 has an end edge 211A on the opening 1A side, the end edge extending along a corresponding opening edge of the opening 1A. Also in the wall base material 21, the second surface 212 has an end edge 212A on the opening 1A side, the end edge extending along a corresponding opening edge of the opening 1A at a position closer to the outdoor OD side than the end edge 211A of the first surface 211 on the opening 1A side and separated from the opening 1A. For example, in a case of the wall base material 21 of the outer wall base 2 corresponding to the opening upper edge of the opening 1A, the end edge 211A of the first surface 211 and the end edge 212A of the second surface 212 extend along the opening upper edge of the opening 1A.

The base plate 22 is made of, for example, plywood, and is attached to the second surface 212 of the wall base material 21 in a manner of covering the second surface 212 from the outdoor OD side. The base plate 22 is attached to the second surface 212 so as not to extend to the opening 1A side up to a region opposed to the first surface 211. In the examples of FIGS. 1 and 2, the base plate 22 is attached to the second surface 212 such that a position of an end surface of the base plate 22 on the opening 1A side coincides with a position of the end edge 212A of the second surface 212 on the opening 1A side.

The fitting 23 is configured by, for example, a window sash, and is attached to the wall base material 21 in a manner of covering the opening 1A. The fitting 23 has a to-be-attached part 231, and is attached to the first surface 211 in a state where the to-be-attached part 231 overlaps the first surface 211 from the outdoor OD side.

The waterproof sheet 24 is a sheet for restricting water entry to the second surface 212 of the wall base material 21 from the outdoor OD side via the base plate 22. The waterproof sheet 24 is attached to the second surface 212 in a manner of covering the base plate 22 from the outdoor OD side. The waterproof sheet 24 is attached to the second surface 212 so as to extend to the opening 1A side up to a region opposed to the first surface 211. A waterproof tape 241 is stuck so as to extend between a part of the waterproof sheet 24 extending to the region opposed to the first surface 211 and the to-be-attached part 231 of the fitting 23.

The first outer wall surface material 3 and the second outer wall surface material 4 are plate materials for configuring an outer wall surface of a building. Usually, the outer wall surface material has a prescribed size, and is attached to an attachment region set in a building as a region corresponding to the prescribed size. However, in a case where the fitting 23 is present in the attachment region, it is necessary to prepare a small outer wall surface material in accordance with a size of an outer region of the fitting 23 in the attachment region and to cause the building to support the small outer wall surface material. The "small outer wall surface material" corresponds to the first outer wall surface material 3. The first outer wall surface material 3 is disposed so as to be opposed to the first surface 211 of the wall base material 21 from the outdoor OD side. The second outer wall surface material 4 is disposed on a side of the first outer wall surface material 3 opposite to the opening 1A so as to be opposed, from the outdoor OD side, to the base plate 22 provided in a manner of covering the second surface 212 of the wall base material 21. In the present embodiment, the first outer wall surface material 3 is formed such that a length L3 from one end surface 31 on the opening 1A side to another end surface 32 opposite to the one end surface 31 is substantially the same as a length from the end edge 211A of the first surface 211 on the opening 1A side to the end edge 212A of the second surface 212 on the opening 1A side. A groove 41 is formed at an end of the second outer wall surface material 4 on the opening 1A side. In a state where an outer wall stopper 9 to be described later is attached to the other end surface 32 of the first outer wall surface material 3, the second outer wall surface material 4 is disposed on the side of the first outer wall surface material 3 opposite to the opening 1A such that a protrusion 92 of the outer wall stopper 9 is inserted into the groove 41.

The support structure 5 is a structure for supporting the first outer wall surface material 3 and the second outer wall surface material 4. The support structure 5 includes a support member 6, a restricting member 7, a support base material 8, and the outer wall stopper 9.

The support member 6 is a member for supporting the first outer wall surface material 3 with respect to the outer wall base 2 in a manner of covering the to-be-attached part 231 of the fitting 23 from the outdoor OD side. As shown in FIG. 2, a plurality of the support members 6 are provided at predetermined intervals in a direction along the end edge 211A of the first surface 211 on the opening 1A side and the end edge 212A of the second surface 212 on the opening 1A side in the wall base material 21. The support member 6 includes a support fixing part 61, a support extension 62, and an end surface support part 63.

The support fixing part 61 is a part, in the support member 6, fixed to the second surface 212 of the wall base material 21 via the base plate 22 and the waterproof sheet 24. The support extension 62 is a part, in the support member 6, that extends from the support fixing part 61 to a region opposed to the first surface 211 of the wall base material 21 toward the opening 1A side to support the first outer wall surface material 3 from the indoor ID side. The end surface support part 63 is a part, in the support member 6, that extends from the support extension 62 to the outdoor OD side and supports the one end surface 31 of the first outer wall surface material 3 on the opening 1A side. The end surface support part 63 has an abutting surface 631 which abuts on the one end surface 31 of the first outer wall surface material 3 on the opening 1A side.

The support fixing part 61 is fixed to the second surface 212 with a screw member SC or the like via the base plate 22 and the waterproof sheet 24 such that a position of a boundary end 611 with respect to the support extension 62, the boundary end being an end edge of the support fixing part 61 on the opening 1A side, substantially coincides with a position of the end edge 212A of the second surface 212 in the wall base material 21 on the opening 1A side. The end surface support part 63 extends from an end 621 of the support extension 62 on the opening 1A side to the outdoor OD side.

In the support member 6 having the above configuration, an opposite surface 632 of the end surface support part 63 opposite to the abutting surface 631 is disposed at a position closest to the opening 1A. Then, in a state where the support fixing part 61 is fixed at a fixing position set in advance on the second surface 212 of the wall base material 21, the support extension 62 has a length by which the opposite surface 632 of the end surface support part 63 opposite to the abutting surface 631 comes into contact with a set surface set in advance on the fitting 23. In other words, a length L1 from a fixing end 612 opposite to the boundary end 611 in the support fixing part 61 to the opposite surface 632 of the end surface support part 63 is set to a length by which the opposite surface 632 of the end surface support part 63 comes into contact with the set surface preset on the fitting 23. In the present embodiment, the set surface set in advance on the fitting 23 corresponds to a contact surface 721 of the restricting member 7 to be described later which is attached to the fitting 23.

In other words, in a state where the support fixing part 61 is fixed at the fixing position set in advance on the second surface 212 of the wall base material 21, the support extension 62 has a length by which the opposite surface 632 of the end surface support part 63 comes into contact with the contact surface 721 of the restricting member 7. In this case, in the state where the support fixing part 61 of the support member 6 is fixed to the second surface 212, the support extension 62 extends between the end edge 211A of the first surface 211 on the opening 1A side and the end edge 212A of the second surface 212 on the opening 1A side so as not to form a gap between the restricting member 7 attached to the fitting 23 and the end surface support part 63. As a result, the support member 6 can support the first outer wall surface material 3 by the support extension 62 and the end surface support part 63 in a manner of covering the entire first surface 211 from the outdoor OD side while restricting formation of a gap between the restricting member 7 attached to the fitting 23 and the end surface support part 63. Therefore, without a protruding object such as a decorative member interposed between the restricting member 7 attached to the fitting 23 and the first outer wall surface material 3, the first outer wall surface material 3 can be supported by the support member 6 in a manner of covering the first surface 211 of the wall base material 21. Moreover, the support member 6 can appropriately support the first outer wall surface material 3 so that a thickness of the first outer wall surface material 3 can be effectively emphasized by shadows cast around the fitting 23 to which the restricting member 7 is attached.

Note that the first outer wall surface material 3 supported by the support member 6 is fixed to the support member 6 by bonding with an adhesive.

In the support member 6, a length extending from the support extension 62 of the end surface support part 63 to the outdoor OD side is set to a length that enables an extension from the first outer wall surface material 3 to the outdoor OD side to be restricted in a state where the end surface support part 63 supports the one end surface 31 of the first outer wall surface material 3 on the opening 1A side. In the present embodiment, the length extending from the support extension 62 of the end surface support part 63 to the outdoor OD side is set to be equal to or less than a dimension in a thickness direction of the one end surface 31 of the first outer wall surface material 3 on the opening 1A side. As a result, between the restricting member 7 attached to the fitting 23 and the first outer wall surface material 3, the end surface support part 63 of the support member 6 is restricted from extending more to the outdoor OD side than the first outer wall surface material 3. Therefore, the support member 6 can appropriately support the first outer wall surface material 3 so that the thickness of the first outer wall surface material 3 can be more effectively emphasized by shadows cast around the fitting 23.

In the present embodiment, in the support member 6, a length L2 from the fixing end 612, which is the end of the support fixing part 61 on the side opposite to the end surface support part 63, to the abutting surface 631 of the end surface support part 63 is set to be longer than the length L3 from the one end surface 31 to the other end surface 32 in the first outer wall surface material 3. In this case, for example, even when it is necessary to support the first outer wall surface material 3 formed such that the length L3 from the one end surface 31 to the other end surface 32 in the first outer wall surface material 3 is substantially the same as the length from the end edge 211A of the first surface 211 on the opening 1A side to the end edge 212A of the second surface 212 on the opening 1A side, the support member 6 can support the first outer wall surface material 3 by the support extension 62 and the end surface support part 63 in a manner of covering the entire first surface 211 from the outdoor OD side in the state where the support fixing part 61 is fixed to the second surface 212.

In addition, as illustrated in FIGS. 1 and 2, the support member 6 further includes a positioning part 64 extending from the fixing end 612 of the support fixing part 61 to the indoor ID side. The positioning part 64 is a part of the support member 6 that is engaged with a to-be-engaged part 81 of the support base material 8. The support base material 8 is a member attached to the second surface 212 via the base plate 22 and the waterproof sheet 24 so as to be interposed between the second surface 212 of the wall base material 21 and the support member 6. The support base material 8 has the to-be-engaged part 81 on an end surface of the support base material 8 on a side opposite to the opening 1A side. The positioning part 64 of the support member 6 is configured to be engaged with the to-be-engaged part 81 of the support base material 8 so as to be able to position the fixing position of the support fixing part 61 with respect to the second surface 212.

In this mode, the support member 6 is disposed such that the positioning part 64 of the support member 6 is engaged with the to-be-engaged part 81 of the support base material 8. As a result, the support fixing part 61 can be fixed to the second surface 212 in a state where the fixing position of the support fixing part 61 with respect to the second surface 212 is positioned such that the opposite surface 632 of the end surface support part 63 of the support member 6 comes into contact with the contact surface 721 of the restricting member 7. Therefore, the support member 6 can support the first outer wall surface material 3 in a manner of covering the entire first surface 211 of the wall base material 21 from the outdoor OD side in a state where formation of a gap between the end surface support part 63 and the restricting member 7 is more reliably restricted. As a result, the support member 6 can appropriately support the first outer wall surface material 3 so that the thickness of the first outer wall surface material 3 can be effectively emphasized by shadows cast around the fitting 23 to which the restricting member 7 is attached.

In the present embodiment, in the support member 6, each of the support fixing part 61, the support extension 62, the end surface support part 63, and the positioning part 64 has the same thickness. The support member 6 is formed of a bent metal plate. Specifically, the support member 6 is formed of a metal plate obtained by bending an area corresponding to a boundary between the support extension 62 and the end surface support part 63 and an area corresponding to a boundary between the support extension 62 and the positioning part 64. In this case, the support member 6 having the end surface support part 63 that supports the one end surface 31 of the first outer wall surface material 3 on the opening 1A side and has a small thickness can be realized by a simple method of bending a metal plate. By reducing the thickness of the end surface support part 63, the first outer wall surface material 3 can be supported in a state where the one end surface 31 of the first outer wall surface material 3 on the opening 1A side is as close to the fitting 23 as possible. Thus, the support member 6 can support the first outer wall surface material 3 in a manner of more reliably covering the entire first surface 11 of the wall base material 21. In addition, the support member 6 can appropriately support the first outer wall surface material 3 by the support extension 62 and the end surface support part 63 so that a thickness of the first outer wall surface material 3 can be more effectively emphasized by shadows cast around the fitting 23.

Note that bending is a method suitable for producing a small amount of the support members 6 as compared with, for example, extrusion molding, and may be able to suppress production costs when producing the support member 6, including man-hours and construction cost. In addition, the bending processing enables reduction of time required to create a dedicated mold material such as extrusion molding.

The restricting member 7 is a member that is attached to the fitting 23 and restricts entry of water from the outdoor OD side to the first surface 211 through between the first outer wall surface material 3 and the restricting member 7. In the support structure 5 including the support member 6 and the restricting member 7, even when the fitting 23 is provided more to the indoor ID side than the first outer wall surface material 3, the set surface for coming into contact with the opposite surface 632 of the end surface support part 63 of the support member 6 can be formed on the contact surface 721 to be described later of the restricting member 7. As a result, while supporting the first outer wall surface material 3 by the support member 6 in a manner of covering the first surface 211 of the wall base material 21 from the outdoor OD side, entry of water from the outdoor OD side to the first surface 211 can be restricted by the restricting member 7 attached to the fitting 23.

The restricting member 7 includes a restricting body 71 and a to-be-contacted part 72. The restricting body 71 configures a body part of the restricting member 7 extending from the fitting 23 to the outdoor OD side. The to-be-contacted part 72 has higher flexibility than the restricting body 71 and is provided on a surface of the restricting body 71 on the side opposite to the opening 1A. The to-be-contacted part 72 has the contact surface 721 that contacts the opposite surface 632 of the end surface support part 63 of the support member 6 from the opening 1A side. As described above, in the restricting member 7, the contact surface 721 in contact with the opposite surface 632 of the end surface support part 63 in the support member 6 is formed on the to-be-contacted part 72 having flexibility. As a result, the opposite surface 632 of the end surface support part 63 and the contact surface 721 of the restricting member 7 can be brought into close contact with each other by flexibility of the to-be-contacted part 72 so as to be liquid-tightly sealed.

A region of the restricting body 71 located more to the outdoor OD side than the to-be-contacted part 72 is disposed at a position more to the opening 1A side than the contact surface 721, thus forming a space for filling a sealing material 10 between the region and the end surface support part 63 of the support member 6. In this case, the sealing material 10 can be filled in the space formed between the restricting body 71 and the end surface support part 63 in the region located more to the outdoor OD side than the to-be-contacted part 72 in the restricting body. As a result, it is possible to more reliably restrict entry of water from the outdoor OD side into the first surface 211 through between the end surface support part 63 of the support member 6 and the restricting member 7 by the sealing material 10.

In addition, the region of the restricting body 71 located more to the outdoor OD side than the to-be-contacted part 72 has an inclined part inclined downward toward the outdoor OD side and a draining part 711 extending downward from an end of the inclined part on the outdoor OD side. This enables water on the region of the restricting body 71 located more to the outdoor OD side than the to-be-contacted part 72 to flow away from the to-be-contacted part 72 according to the downward inclination, and enables the water to be guided downward from the draining part 711.

The outer wall stopper 9 is a jig for supporting the second outer wall surface material 4 such that the second outer wall surface material 4 is disposed on the side of the first outer wall surface material 3 opposite to the opening 1A. As shown in FIG. 2, a plurality of outer wall stoppers 9 are provided at predetermined intervals in a direction along the end edge 211A of the first surface 211 on the opening 1A side and the end edge 212A of the second surface 212 on the opening 1A side in the wall base material 21. In a side view seen from a direction perpendicular to the first surface 211 and the second surface 212, the support member 6 and the outer wall stopper 9 are alternately aligned.

The outer wall stopper 9 has a mounting part 91 mounted on the other end surface 32 of the first outer wall surface material 3 supported by the support member 6, the protrusion 92 protruding from the mounting part 91 and inserted into the groove 41 of the second outer wall surface material 4, a support part 93 for supporting the second outer wall surface material 4 from the indoor ID side, and a fixing part 94 fixed to the second surface 212 by the screw member SC or the like via the base plate 22 and the waterproof sheet 24. In the outer wall stopper 9, the protrusion 92 is inserted into the groove 41 of the second outer wall surface material 4 in a state where the mounting part 91 is mounted on the other end surface 32 of the first outer wall surface material 3 and the fixing part 94 is fixed to the second surface 212, whereby the second outer wall surface material 4 can be supported from the indoor ID side by the support part 93.

[Construction Procedure of Outer Wall Structure]

Next, a construction procedure for the outer wall structure 1 will be described with reference to FIGS. 3 to 5 in addition to FIGS. 1 and 2.

First, the outer wall base 2 including the wall base material 21, the base plate 22, the fitting 23, and the waterproof sheet 24 is constructed. Specifically, the wall base material 21 is installed in a manner of surrounding the opening 1A. When the wall base material 21 is installed, the base plate 22 is attached to the second surface 212 in a manner of covering the second surface 212 of the wall base material 21 from the outdoor OD side, and the waterproof sheet 24 is attached to the second surface 212 in a manner of covering the base plate 22 from the outdoor OD side. The fitting 23 is attached to the first surface 211 of the wall base material 21 in a state where the to-be-attached part 231 overlaps the first surface 211 from the outdoor OD side. On this occasion, the waterproof tape 241 is stuck so as to extend between a part of the waterproof sheet 24 extending to a region opposed to the first surface 211 and the to-be-attached part 231 of the fitting 23.

When the construction of the outer wall base 2 is completed, the support structure 5 is constructed on the outer wall base 2. First, the restricting member 7 is attached to the fitting 23. On this occasion, the restricting member 7 is attached to the fitting 23 such that the contact surface 721 of the to-be-contacted part 72 faces the side opposite to the opening 1A.

Figure 3:
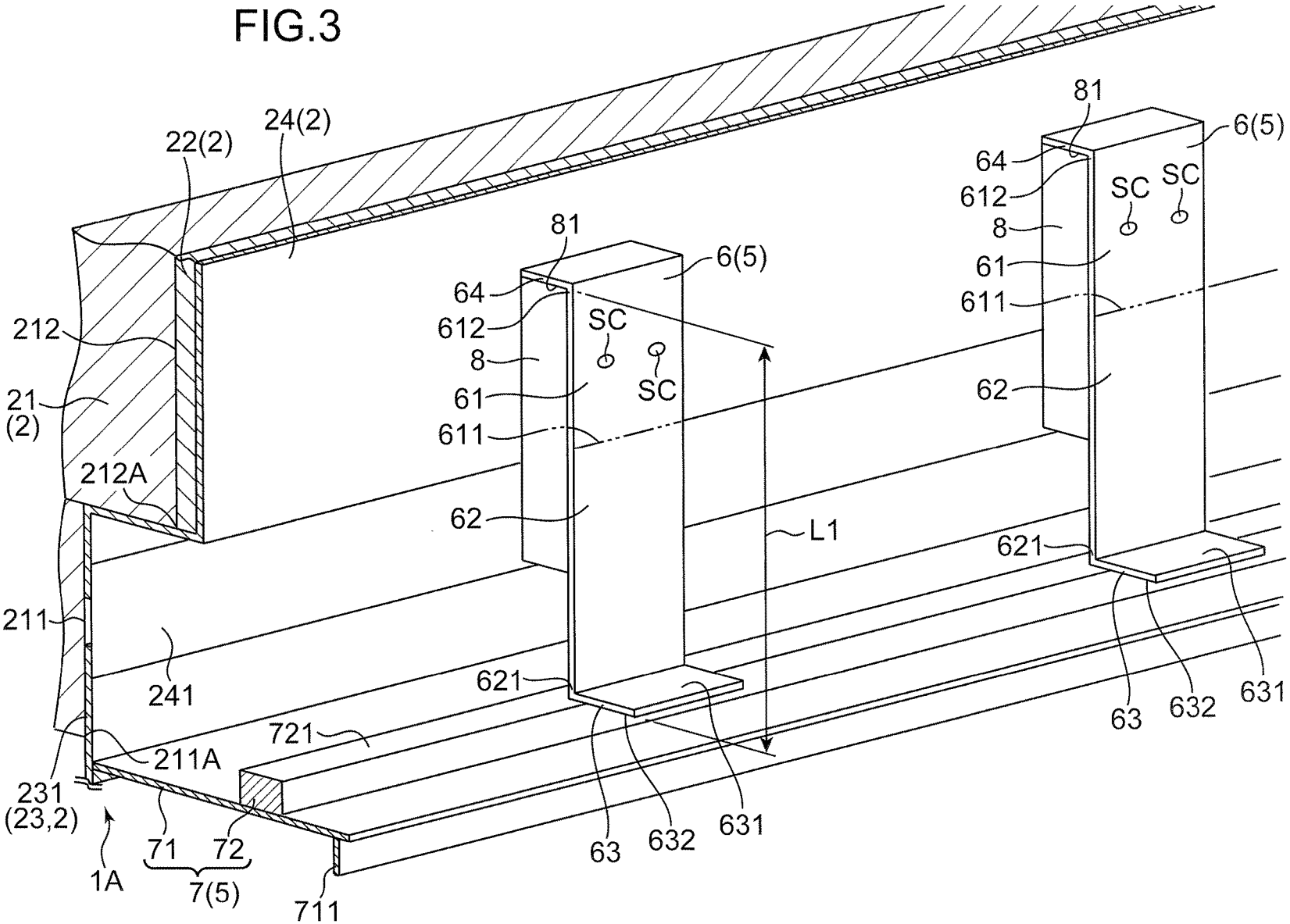
FIG. 3 is a perspective view illustrating a construction procedure of the outer wall structure, and is a view illustrating a state in which the support member is attached to a second surface of a wall base material.

Next, as illustrated in FIG. 3, the support base material 8 is attached to the second surface 212 via the base plate 22 and the waterproof sheet 24. On this occasion, the support base material 8 is attached to the second surface 212 such that the to-be-engaged part 81 of the support base material 8 is located at a position separated from the contact surface 721 of the to-be-contacted part 72 of the restricting member 7 by a distance corresponding to the length L1 of the support member 6. The length L1 of the support member 6 is a length from the fixing end 612 of the support fixing part 61 to the opposite surface 632 of the end surface support part 63.

Next, as shown in FIG. 3, the support member 6 is disposed such that the positioning part 64 of the support member 6 is engaged with the to-be-engaged part 81 of the support base material 8. Specifically, the support fixing part 61 is fixed to the second surface 212 by the screw member SC in a state where the positioning part 64 is engaged with the to-be-engaged part 81 of the support base material 8. In the support member 6, in the state where the support fixing part 61 is fixed to the second surface 212, the support extension 62 extends between the end edge 211A of the first surface 211 on the opening 1A side and the end edge 212A of the second surface 212 on the opening 1A side, and the opposite surface 632 of the end surface support part 63 contacts the contact surface 721 of the restricting member 7.

Figure 4:
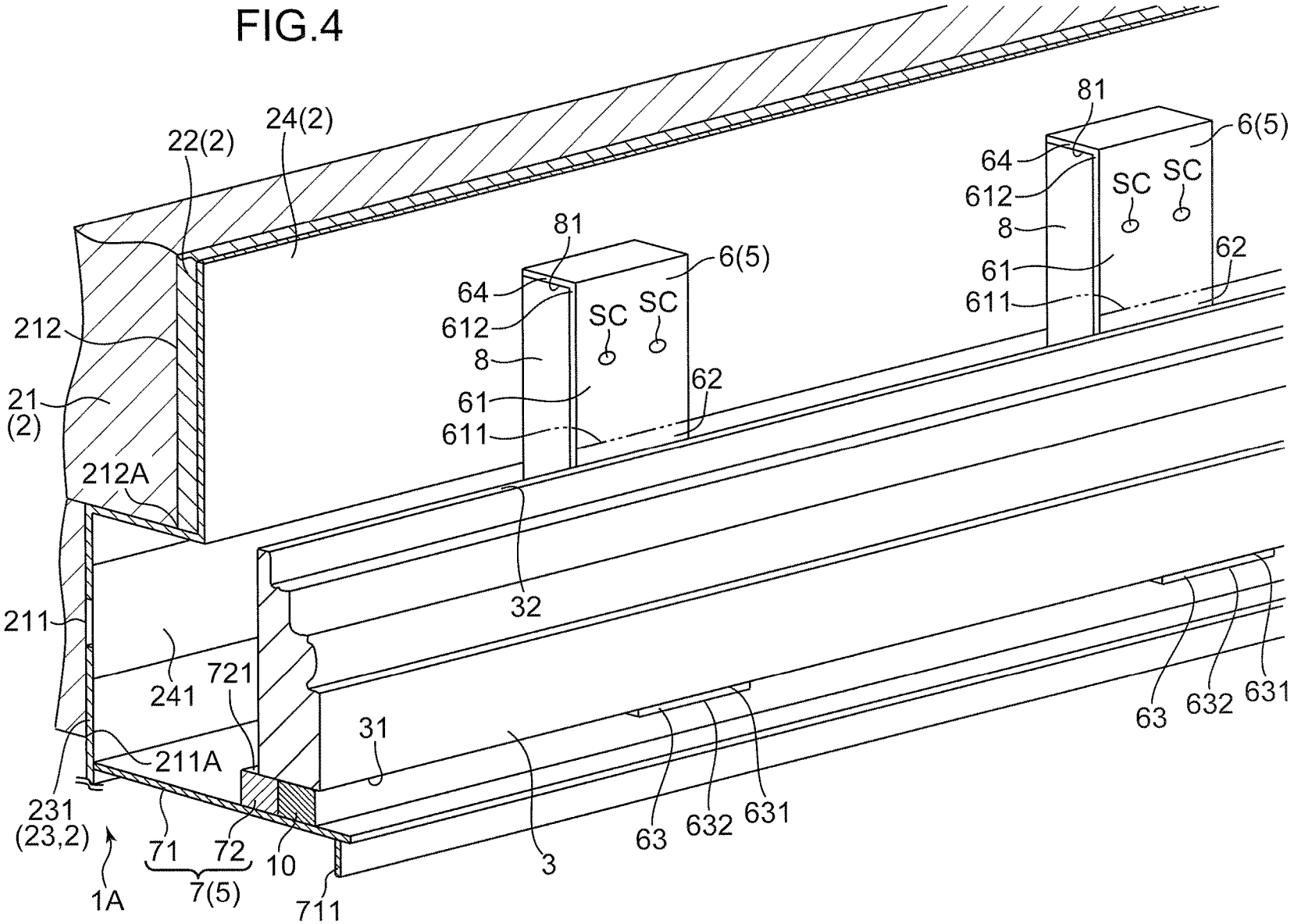
FIG. 4 is a perspective view illustrating the construction procedure of the outer wall structure, and is a view illustrating a state in which a first outer wall surface material is disposed for the support member.

Next, as shown in FIG. 4, the first outer wall surface material 3 is disposed so as to be supported by the support member 6. The first outer wall surface material 3 supported by the support member 6 is fixed to the support member 6 by bonding with an adhesive. When disposing the first outer wall surface material 3 is completed, the sealing material 10 is filled between the region of the restricting body 71 of the restricting member 7 located more to the outdoor OD side than the to-be-contacted part 72 and the one end surface 31 of the first outer wall surface material 3. On this occasion, with respect to a part supported by the end surface support part 63 of the support member 6 on the one end surface 31 of the first outer wall surface material 3, the sealing material 10 is filled between the region of the restricting body 71 of the restricting member 7 located more to the outdoor OD side than the to-be-contacted part 72 and the end surface support part 63. The support member 6 supports the first outer wall surface material 3 by the support extension 62 and the end surface support part 63 in a manner of covering the entire first surface 211 from the outdoor OD side. This enables the support member 6 to appropriately support the first outer wall surface material 3 so that the thickness of the first outer wall surface material 3 can be effectively emphasized by shadows cast around the fitting 23 to which the restricting member 7 is attached.

Figure 5:
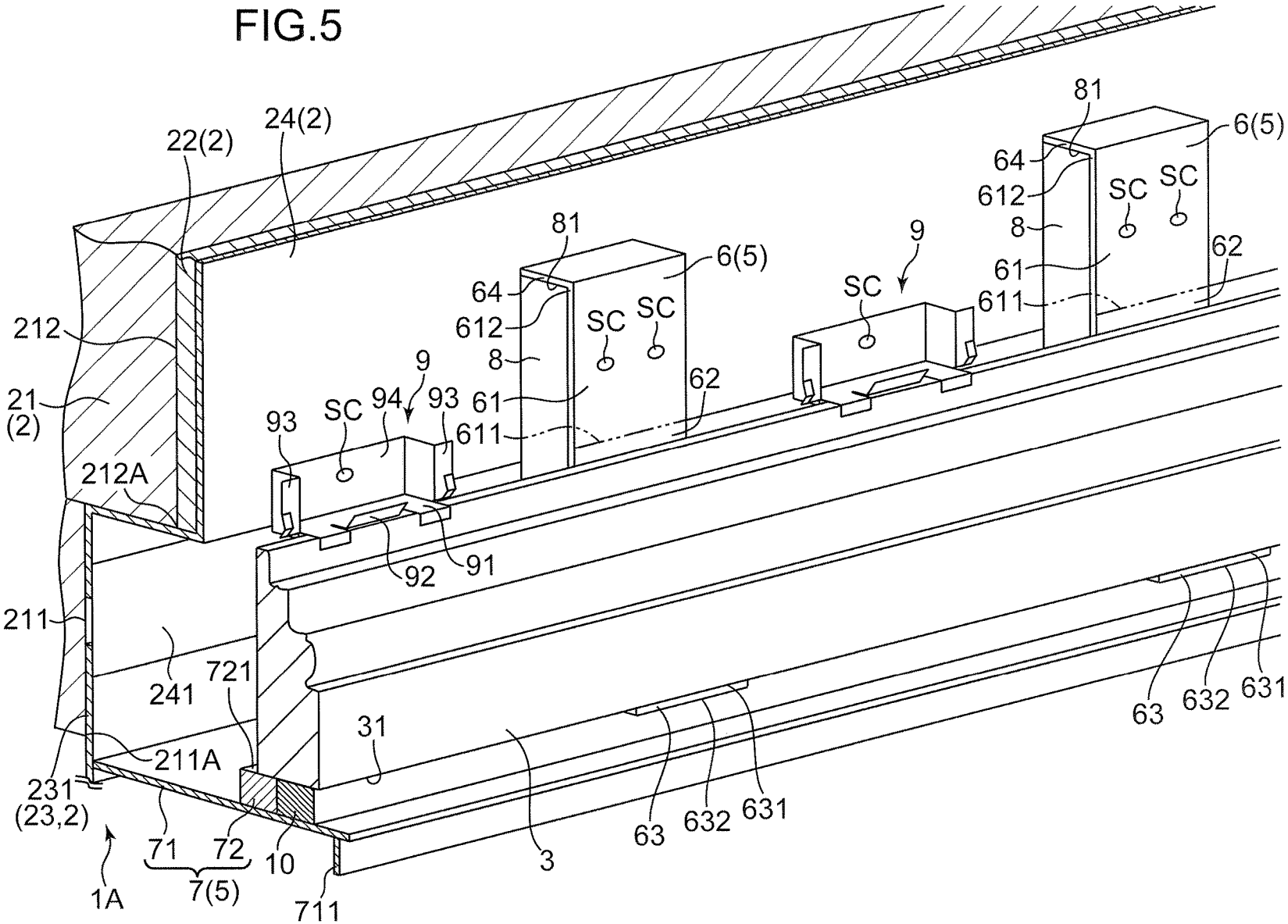
FIG. 5 is a perspective view illustrating the construction procedure of the outer wall structure, and is a view illustrating a state in which an outer wall stopper for installing a second outer wall surface material on a side of the first outer wall surface material opposite to an opening is attached to the first outer wall surface material.

Next, as shown in FIG. 5, the outer wall stopper 9 is disposed at the first outer wall surface material 3 supported by the support member 6. Specifically, the fixing part 94 is fixed to the second surface 212 by the screw member SC in the state where the mounting part 91 is mounted on the other end surface 32 of the first outer wall surface material 3.

Then, the second outer wall surface material 4 is disposed on the side of the first outer wall surface material 3 opposite to the opening 1A so as to be supported by the outer wall stopper 9. On this occasion, in the outer wall stopper 9, the protrusion 92 is inserted into the groove 41 of the second outer wall surface material 4, and the support part 93 supports the second outer wall surface material 4 from the indoor ID side.

On the basis of the construction according to the above construction procedure, the outer wall structure 1 can be constructed which includes the outer wall base 2, the first outer wall surface material 3 and the second outer wall surface material 4 provided at the outer wall base 2, and the support structure 5 for supporting the first outer wall surface material 3 and the second outer wall surface material 4. As has been described, in the outer wall structure 1, the support member 6 of the support structure 5 can appropriately support the first outer wall surface material 3 for the outer wall base 2 including the wall base material 21 and the fitting 23 so that the thickness of the first outer wall surface material 3 can be effectively emphasized by shadows cast around the fitting 23.

In the support structure 5 of the outer wall structure 1, the restricting member 7 may be omitted. In this case, the set surface for coming into contact with the opposite surface 632 of the end surface support part 63 of the support member 6 is set in advance on the fitting 23 itself.

Although the outer wall structure 1 to which the support member 6 and the support structure 5 according to the embodiment of the present invention are applied has been described in the foregoing, the present invention is not limited thereto, and for example, the following modified embodiment can be adopted.

Although in the above embodiment, the description has been made of the mode in which each of the support fixing part 61, the support extension 62, the end surface support part 63, and the positioning part 64 configuring the support member 6 has the same thickness, the present invention is not limited thereto. A support member 6A according to a modified embodiment to be applied to the outer wall structure 1 will be described with reference to FIG. 6.

Figure 6:
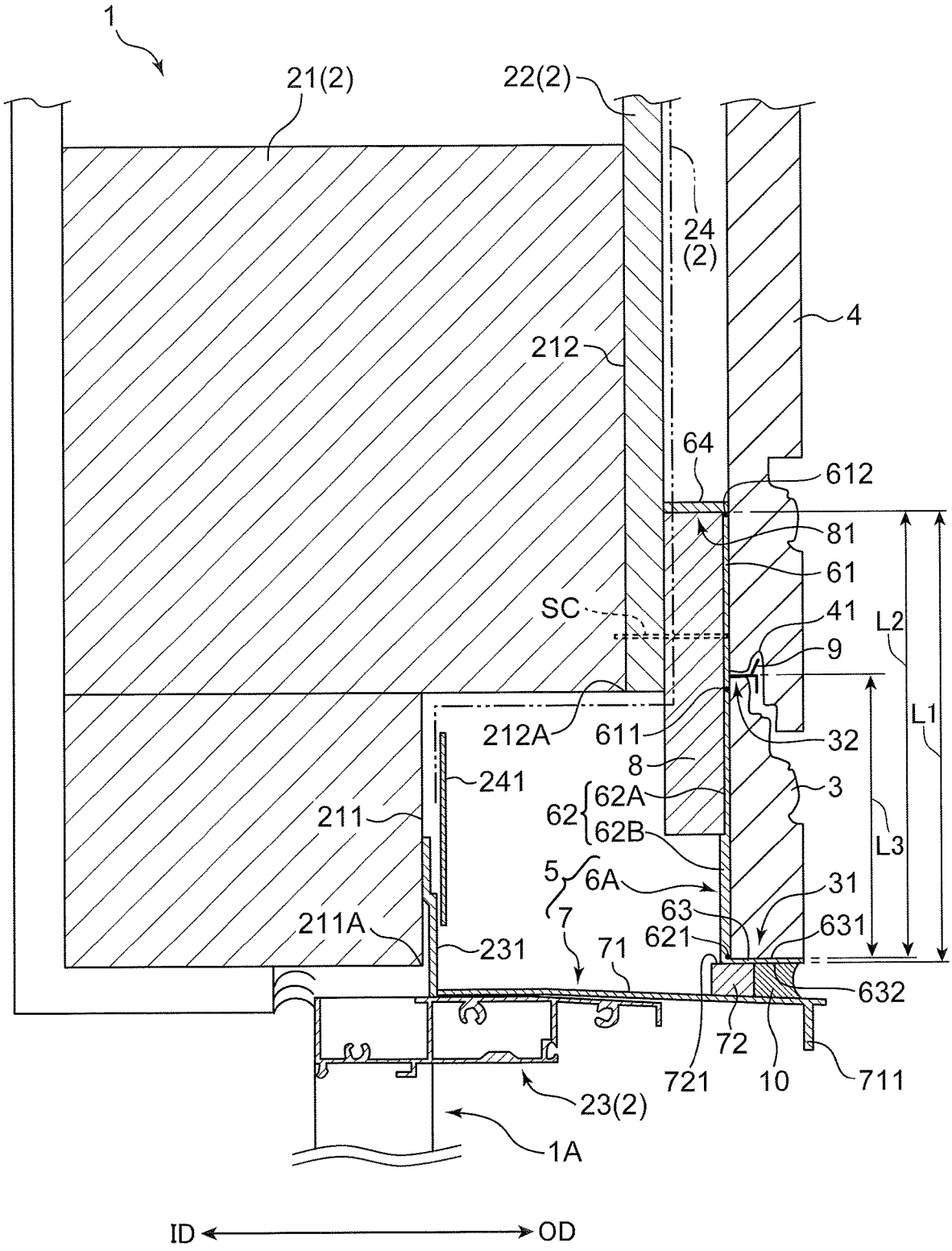
FIG. 6 is a side cross-sectional view illustrating an outer wall structure to which a support member and a support structure according to a modified embodiment are applied.

Similarly to the support member 6, the support member 6A illustrated in FIG. 6 includes the support fixing part 61, the support extension 62, the end surface support part 63, and the positioning part 64. Then, the support member 6A is configured similarly to the above-described support member 6 except for a mode related to the thickness of each part configuring the support member 6A.

The support extension 62 of the support member 6A has a base abutting part 62A and an extension part 62B. The base abutting part 62A is a part that extends from the support fixing part 61 to the opening 1A side and abuts on the support base material 8 from the outdoor OD side in the state where the positioning part 64 is engaged with the to-be-engaged part 81 of the support base material 8. The extension part 62B is a part extending from the base abutting part 62A more to the opening 1A side than the support base material 8. In the configuration in which the support extension 62 has the base abutting part 62A and the extension part 62B, the end surface support part 63 extends from the end 621 of the extension part 62B on the opening 1A side to the outdoor OD side.

In the support extension 62, the extension part 62B is a part having a thickness larger than the thickness of the end surface support part 63 as a reference. As a result, it is possible to realize the support member 6A that while including the end surface support part 63 having a small thickness, includes the support extension 62 having the extension part 62B whose thickness is larger than that of the end surface support part 63. By reducing the thickness of the end surface support part 63, the first outer wall surface material 3 can be supported in a state where the one end surface 31 of the first outer wall surface material 3 on the opening 1A side is as close to the fitting 23 as possible. Thus, the support member 6A can support the first outer wall surface material 3 in a manner of more reliably covering the entire first surface 11 of the wall base material 21. In addition, the support member 6A can appropriately support the first outer wall surface material 3 by the support extension 62 and the end surface support part 63 so that a thickness of the first outer wall surface material 3 can be more effectively emphasized by shadows cast around the fitting 23. Further, since the support extension 62 has the extension part 62B having the thickness larger than that of the end surface support part 63, the support extension 62 can be reinforced such that the support extension 62 can be restricted from bending toward the indoor ID side when the support extension 62 supports the first outer wall surface material 3 from the indoor ID side.

In the support extension 62, the base abutting part 62A has the same thickness as the end surface support part 63. By reducing the thickness of the base abutting part 62A similarly to the end surface support part 63, the first outer wall surface material 3 can be supported such that displacement of the first outer wall surface material 3 toward the outdoor OD side can be restricted when the first outer wall surface material 3 is supported from the indoor ID side by the support extension 62.

In addition, the support fixing part 61 of the support member 6A has the same thickness as the end surface support part 63, similarly to the base abutting part 62A of the support extension 62. The support fixing part 61 has a function of supporting the end of the second outer wall surface material 4 on the opening 1A side from the indoor ID side while being fixed to the second surface 212 of the wall base material 21. By reducing the thickness of the support fixing part 61 similarly to the end surface support part 63, the second outer wall surface material 4 can be supported such that displacement of the second outer wall surface material 4 toward the outdoor OD side can be restricted when the second outer wall surface material 4 is supported from the indoor ID side by the support fixing part 61.

In addition, similarly to the extension part 62B of the support extension 62, the positioning part 64 of the support member 6A may be formed to have a thickness larger than the thickness of the end surface support part 63 as a reference. In the state of being engaged with the to-be-engaged part 81 of the support base material 8, the positioning part 64 supports a weight of the first outer wall surface material 3 supported by the support extension 62 and the end surface support part 63. In this case, by making the thickness of the positioning part 64 larger than that of the end surface support part 63, the positioning part 64 can be reinforced so as to obtain strength for supporting the weight of the first outer wall surface material 3.

The support member 6A in which the thicknesses of the support fixing part 61, the support extension 62, the end surface support part 63, and the positioning part 64 are set as described above can be formed by extrusion molding, for example. The extrusion molding is a method suitable for producing the support member 6A having a plurality of areas having different thicknesses as compared with the bending, and can stably produce a large amount of the support members 6A having the same shape.

Note that the above-described specific embodiment mainly includes the invention having the following configurations.

A support member according to one aspect of the present invention is a member for supporting an outer wall surface material in a manner of covering a to-be-attached part from an outdoor side with respect to an outer wall base including: a wall base material provided in a manner of surrounding an opening that communicates between indoor and outdoor sides and faces the side, and having a first surface adjacent to the opening and facing the outdoor side and a second surface provided on a side of the first surface opposite to the opening and positioned more to the outdoor side than the first surface; and a fitting attached to the wall base material in a manner of covering the opening, and having the to-be-attached part that is attached to the first surface in a state of being overlapped with the first surface from the outdoor side. The support member includes: a support fixing part fixed to the second surface; a support extension that extends from the support fixing part to a region opposed to the first surface toward the opening side to support the outer wall surface material from the indoor side; and an end surface support part that extends from the support extension to the outdoor side and has an abutting surface that abuts on one end surface of the outer wall surface material on the opening side to support the one end surface.

According to this support member, the outer wall surface material is supported in a manner of covering the first surface from the outdoor side with respect to the wall base material having the first surface adjacent to the opening and facing the outdoor side and the second surface located more to the outdoor side than the first surface on the side of the first surface opposite to the opening. Specifically, in the support member, in a state where the support fixing part is fixed to the second surface, the support extension extending from the support fixing part toward the opening side supports the outer wall surface material from the indoor side, and the abutting surface of the end surface support part extending from the support extension toward the outdoor side abuts on the one end surface of the outer wall surface material on the opening side to support the one end surface. With such a support member, even without a decorative member interposed between the outer wall surface material and the fitting, the outer wall surface material can be supported in a manner of covering the first surface of the wall base material. Furthermore, the support member can appropriately support the outer wall surface material so that a thickness of the outer wall surface material can be effectively emphasized by shadows cast around the fitting.

In the above support member, the support extension may be configured to have a length by which an opposite surface of the abutting surface in the end surface support part comes into contact with a set surface provided on the fitting in a state where the support fixing part is fixed at a fixing position on the second surface.

In this mode, the support extension has a length by which the opposite surface of the abutting surface in the end surface support part comes into contact with the set surface provided on the fitting in the state where the support fixing part is fixed at the fixing position on the second surface. In this case, in the state where the support fixing part of the support member is fixed to the second surface, the support extension extends between an end edge of the first surface on the opening side and an end edge of the second surface on the opening side so as not to form a gap between the end surface support part and the fitting. As a result, the support member can support the outer wall surface material by the support extension and the end surface support part in a manner of covering the entire first surface from the outdoor side in a state where formation of a gap between the end surface support part and the fitting is restricted. Therefore, even without a decorative member interposed between the outer wall surface material and the fitting, the outer wall surface material can be supported by the support member in a manner of covering the first surface of the wall base material.

In the above support member, a length from an end of the support fixing part on a side opposite to the end surface support part to the abutting surface of the end surface support part may be set to be longer than a length from the one end surface to the other end surface of the outer wall surface material.

Usually, the outer wall surface material has a prescribed size, and is attached to an attachment region set in a building as a region corresponding to the prescribed size. However, in a case where the fitting is present in the attachment region, it is necessary to prepare a small outer wall surface material in accordance with a size of an outer region of a fitting in the attachment region and to cause the building to support the small outer wall surface material. For example, even when it is necessary to support the outer wall surface material formed such that the length from one end surface on the opening side to the other end surface in the outer wall surface material is substantially the same as the length from the end edge of the first surface on the opening side to the end edge of the second surface on the opening side, the above mode enables the support member to support the outer wall surface material by the support extension and the end surface support part in a manner of covering the entire first surface from the outdoor side in the state where the support fixing part is fixed to the second surface.

In the above support member, the support fixing part, the support extension, and the end surface support part may be configured to have the same thickness.

In this mode, the support member having the end surface support part that supports the one end surface of the outer wall surface material on the opening side and has a small thickness can be realized by a simple method. By reducing the thickness of the end surface support part, the outer wall surface material can be supported in a state where the one end surface of the outer wall surface material on the opening side is as close to the fitting as possible. Thus, the support member can support the outer wall surface material in a manner of more reliably covering the entire first surface of the wall base material. In addition, the support member can appropriately support the outer wall surface material by the support extension and the end surface support part so that a thickness of the outer wall surface material can be more effectively emphasized by shadows cast around the fitting.

In the above support member, the support extension may have a part having a thickness larger than a thickness of the end surface support part as a reference.

In this mode, it is possible to realize the support member that while including the end surface support part having a small thickness, includes the support extension having the part having the thickness larger than that of the end surface support part. Since the support extension has the part having the thickness larger than that of the end surface support part, the support extension can be reinforced such that the support extension can be restricted from bending toward the indoor side when the support extension supports the outer wall surface material from the indoor side.

The above support member may be configured to further include a positioning part that is engaged with a to-be-engaged part provided on the second surface of the wall base material for positioning the support fixing part at the fixing position.

When the support base material having the to-be-engaged part is attached to the second surface of the wall base material, the to-be-engaged part may be set in advance on the second surface. In this case, the support member is disposed such that the positioning part of the support member is engaged with the to-be-engaged part. As a result, the support fixing part can be fixed to the second surface in a state where the fixing position of the support fixing part with respect to the second surface is positioned such that the opposite surface of the end surface support part of the support member comes into contact with the set surface that is set on the fitting in advance. Therefore, the support member can support the outer wall surface material in a manner of covering the entire first surface of the wall base material from the outdoor side in a state where formation of a gap between the end surface support part and the fitting is more reliably restricted.

A support structure according to another aspect of the present invention includes: the above support member; and a restricting member attached to the fitting for restricting entry of water into the first surface from an outdoor side through between the restricting member and the outer wall surface material. Then, the restricting member has a contact surface extending from the fitting to the outdoor side and coming into contact with the end surface support part of the support member from the opening side.

According to this support structure, even when the fitting is provided more to the indoor side than the outer wall surface material, a surface for coming into contact with the opposite surface of the end surface support part of the support member can be formed on the contact surface of the restricting member. As a result, while supporting the outer wall surface material by the support member in a manner of covering the first surface of the wall base material from the outdoor side, entry of water from the outdoor side to the first surface can be restricted by the restricting member attached to the fitting.

In the above support structure, a region of the restricting member located more to the outdoor side than the contact surface may be disposed at a position more to the opening side than the contact surface, to form a space for filling a sealing material between the region and the end surface support part.

In this mode, the sealing material can be filled in the space formed between the restricting member and the end surface support part in the region of the restricting member located more to the outdoor side than the contact surface. As a result, it is possible to more reliably restrict entry of water from the outdoor side into the first surface through between the end surface support part of the support member and the restricting member by the sealing material.

In the above support structure, a region of the restricting member located more to the outdoor side than the contact surface may have an inclined part inclined downward toward the outdoor side and a draining part extending downward from an end of the inclined part on the outdoor side.

This mode enables water on the region of the restricting member located more to the outdoor side than the contact surface to flow away from the contact surface according to the downward inclination, and the water to be guided downward from the draining part.

In the above support structure, the restricting member may have a main body, and a to-be-contacted part having higher flexibility than the main body, the to-be-contacted part having the contact surface.

In this mode, in the restricting member, the contact surface in contact with the opposite surface of the end surface support part in the support member is formed on the to-be-contacted part having flexibility. As a result, the opposite surface of the end surface support part and the contact surface of the restricting member can be brought into close contact with each other by flexibility of the to-be-contacted part so as to be liquid-tightly sealed.

An outer wall structure according to a further aspect of the present invention is an outer wall structure of a building. The outer wall structure includes: a wall base material provided in a manner of surrounding an opening that communicates between indoor and outdoor sides and faces the side, and having a first surface adjacent to the opening and facing the outdoor side and a second surface provided on a side of the first surface opposite to the opening and positioned more to the outdoor side than the first surface; a fitting attached to the wall base material in a manner of covering the opening, and having a to-be-attached part that is attached to the first surface in a state of being overlapped with the first surface from the outdoor side; an outer wall surface material provided for the wall base material and the fitting; and the support member for supporting the outer wall surface material in a manner of covering the to-be-attached part of the fitting from the outdoor side.

As described in the foregoing, the present invention provides a support member and a support structure for supporting an outer wall surface material in a manner of covering a first surface of a wall base material without using a decorative member, and to provide an outer wall structure.

The invention claimed is:

1. A support member for supporting an outer wall surface material in a manner of covering a to-be-attached part from an outdoor side with respect to an outer wall base including: a wall base material provided in a manner of surrounding an opening that communicates between an indoor side and the outdoor side and faces the outdoor side, and having a first surface adjacent to the opening and facing the outdoor side and a second surface provided on a side of the first surface opposite to the opening and positioned more to the outdoor side than the first surface; and a fitting attached to the wall base material in a manner of covering the opening, and having the to-be-attached part that is attached to the first surface in a state of being overlapped with the first surface from the outdoor side, the support member comprising:

a support fixing part fixed to the second surface;

a support extension that extends from the support fixing part to a region opposed to the first surface toward the opening to support the outer wall surface material from the indoor side; and an end surface support part that extends from the support extension to the outdoor side and has an abutting surface that abuts on one end surface of the outer wall surface material on the opening side to support the one end surface, wherein a length from an end of the support fixing part on a side opposite to the end surface support part to the abutting surface of the end surface support part is set to be longer than a length from the one end surface to another end surface of the outer wall surface material.

2. The support member according to claim 1, wherein the support extension has a length by which an opposite surface of the abutting surface in the end surface support part comes into contact with a set surface provided on the fitting in a state where the support fixing part is fixed at a fixing position on the second surface.

3. The support member according to claim 1, wherein the support fixing part, the support extension, and the end surface support part have the same thickness.

4. A support structure comprising:

the support member according to claim 1; and a restricting member attached to the fitting for restricting entry of water into the first surface from an outdoor side through between the restricting member and the outer wall surface material, wherein the restricting member has a contact surface extending from the fitting to the outdoor side and coming into contact with the end surface support part of the support member from the opening side.

5. The support structure according to claim 4, wherein a region of the restricting member located more to the outdoor side than the contact surface is disposed at a position more to the opening side than the contact surface, to form a space for filling a sealing material between the region and the end surface support part.

6. The support structure according to claim 4, wherein the region of the restricting member located more to the outdoor side than the contact surface has an inclined part inclined downward toward the outdoor side and a draining part extending downward from an end of the inclined part on the outdoor side.

7. The support structure according to claim 4, wherein the restricting member has a main body, and a to-be-contacted part having higher flexibility than the main body, and the to-be-contacted part has the contact surface.

8. A support member for supporting an outer wall surface material in a manner of covering a to-be-attached part from an outdoor side with respect to an outer wall base including: a wall base material provided in a manner of surrounding an opening that communicates between an indoor side and the outdoor side and faces the outdoor side, and having a first surface adjacent to the opening and facing the outdoor side and a second surface provided on a side of the first surface opposite to the opening and positioned more to the outdoor side than the first surface; and a fitting attached to the wall base material in a manner of covering the opening, and having the to-be-attached part that is attached to the first surface in a state of being overlapped with the first surface from the outdoor side, the support member comprising:

a support fixing part fixed to the second surface;

a support extension that extends from the support fixing part to a region opposed to the first surface toward the opening to support the outer wall surface material from the indoor side; and an end surface support part that extends from the support extension to the outdoor side and has an abutting surface that abuts on one end surface of the outer wall surface material on the opening side to support the one end surface, wherein the support extension has a part having a thickness larger than a thickness of the end surface support part as a reference.

9. A support member for supporting an outer wall surface material in a manner of covering a to-be-attached part from an outdoor side with respect to an outer wall base including: a wall base material provided in a manner of surrounding an opening that communicates between an indoor side and the outdoor side and faces the outdoor side, and having a first surface adjacent to the opening and facing the outdoor side and a second surface provided on a side of the first surface opposite to the opening and positioned more to the outdoor side than the first surface; and a fitting attached to the wall base material in a manner of covering the opening, and having the to-be-attached part that is attached to the first surface in a state of being overlapped with the first surface from the outdoor side, the support member comprising:

a support fixing part fixed to the second surface;

a support extension that extends from the support fixing part to a region opposed to the first surface toward the opening to support the outer wall surface material from the indoor side;

an end surface support part that extends from the support extension to the outdoor side and has an abutting surface that abuts on one end surface of the outer wall surface material on the opening side to support the one end surface; and a positioning part that is engaged with a to-be-engaged part provided on the second surface of the wall base material so as to position the support fixing part at the fixing position, wherein the positioning part extends from an end of the support fixing part, which is on a side opposite to the end surface support part, to the indoor side.

10. An outer wall structure of a building, comprising:

a wall base material provided in a manner of surrounding an opening that communicates between an indoor side and an outdoor side and faces the outdoor side, and having a first surface adjacent to the opening and facing the outdoor side and a second surface provided on a side of the first surface opposite to the opening and positioned more to the outdoor side than the first surface;

a fitting attached to the wall base material in a manner of covering the opening, and having a to-be-attached part that is attached to the first surface in a state of being overlapped with the first surface from the outdoor side;

an outer wall surface material provided for the wall base material and the fitting; and the support member according to claim 1 for supporting the outer wall surface material in a manner of covering the to-be-attached part of the fitting from the outdoor side.

11. A support structure comprising:

the support member according to claim 5; and a restricting member attached to the fitting for restricting entry of water into the first surface from an outdoor side through between the restricting member and the outer wall surface material, wherein the restricting member has a contact surface extending from the fitting to the outdoor side and coming into contact with the end surface support part of the support member from the opening side.

12. A support structure comprising:

the support member according to claim 6; and a restricting member attached to the fitting for restricting entry of water into the first surface from an outdoor side through between the restricting member and the outer wall surface material, wherein the restricting member has a contact surface extending from the fitting to the outdoor side and coming into contact with the end surface support part of the support member from the opening side.

13. An outer wall structure of a building, comprising:

a wall base material provided in a manner of surrounding an opening that communicates between an indoor side and an outdoor side and faces the outdoor side, and having a first surface adjacent to the opening and facing the outdoor side and a second surface provided on a side of the first surface opposite to the opening and positioned more to the outdoor side than the first surface;

a fitting attached to the wall base material in a manner of covering the opening, and having a to-be-attached part that is attached to the first surface in a state of being overlapped with the first surface from the outdoor side;

an outer wall surface material provided for the wall base material and the fitting; and the support member according to claim 8 for supporting the outer wall surface material in a manner of covering the to-be-attached part of the fitting from the outdoor side.

14. An outer wall structure of a building, comprising:

a wall base material provided in a manner of surrounding an opening that communicates between an indoor side and an outdoor side and faces the outdoor side, and having a first surface adjacent to the opening and facing the outdoor side and a second surface provided on a side of the first surface opposite to the opening and positioned more to the outdoor side than the first surface;

a fitting attached to the wall base material in a manner of covering the opening, and having a to-be-attached part that is attached to the first surface in a state of being overlapped with the first surface from the outdoor side;

an outer wall surface material provided for the wall base material and the fitting; and the support member according to claim 9 for supporting the outer wall surface material in a manner of covering the to-be-attached part of the fitting from the outdoor side.

* * * * *